US005425500A

United States Patent [19]

Sauerwine

[11] Patent Number: 5,425,500

[45] Date of Patent: Jun. 20, 1995

[54] ECCENTRIC DOUBLE PARALLEL FOLDED MAILER

[75] Inventor: Dean N. Sauerwine, Emmaus, Pa.

[73] Assignee: Moore Business Forms, Inc., Grand Island, N.Y.

[21] Appl. No.: 137,779

[22] Filed: Oct. 19, 1993

[51] Int. Cl.[6] ..... B65D 27/04; B65D 27/06

[52] U.S. Cl. ..... 229/303; 229/71; 229/97.3; 229/305

[58] Field of Search ..... 229/304, 92.3, 71, 302, 229/303, 301, 305

[56] References Cited

U.S. PATENT DOCUMENTS

| | | | |
|---|---|---|---|
| 1,145,935 | 7/1915 | Steinke | 229/302 |
| 1,364,918 | 1/1921 | Conrad | 229/71 |
| 1,708,574 | 4/1929 | Hazen . | |
| 2,669,464 | 2/1954 | Lay et al. . | |
| 2,910,222 | 10/1959 | Bermingham, Jr. et al. . | |
| 2,983,431 | 5/1961 | Turan . | |
| 3,126,148 | 3/1964 | Hanson . | |
| 3,152,800 | 10/1964 | Hanson . | |
| 3,184,150 | 5/1965 | Hubbard . | |
| 3,652,007 | 3/1972 | MacDougall . | |
| 3,693,869 | 9/1972 | Eaves, Jr. | 229/304 |
| 3,701,468 | 10/1972 | Steinhauser . | |
| 3,908,892 | 9/1975 | Pelzer . | |
| 4,044,942 | 8/1977 | Sherwood | 229/305 |
| 4,055,294 | 10/1977 | Traise | 229/304 |
| 4,308,987 | 1/1982 | Solomon | 229/302 |
| 4,669,652 | 6/1987 | Seguin . | |
| 4,706,878 | 11/1987 | Lubotta et al. . | |
| 4,799,618 | 1/1989 | Jenkins . | |
| 4,896,823 | 1/1990 | Taylor . | |
| 4,915,287 | 4/1990 | Volk et al. . | |
| 4,928,875 | 5/1990 | Hutchinson . | |
| 5,060,847 | 10/1991 | Angus . | |
| 5,125,563 | 6/1992 | Lombardo . | |
| 5,174,493 | 12/1992 | File . | |
| 5,201,464 | 4/1993 | File . | |

*Primary Examiner*—Stephen P. Garbe
*Attorney, Agent, or Firm*—Nixon & Vanderhye

[57] ABSTRACT

An intermediate for a mailer type business form, and a mailer formed from the intermediate, have a fourth panel/ply of lesser width that the other three panels/-plies, which forms a reply envelope flap. A cutout is formed in one of the panels/plies forming a reply envelope, through which cutout the outgoing and reply addresses are visible. The reply address is provided on a flap connected by a fold line to one of the panels/plies forming the reply envelope, and is aligned with the cutout when the reply address flap is folded into the interior of the reply envelope. Other reply address flaps, having different reply addresses, also may be provided.

20 Claims, 7 Drawing Sheets

ECCENTRIC DOUBLE PARALLEL FOLDED MAILER

BACKGROUND AND SUMMARY OF THE INVENTION

Mailers are widely used types of business forms, which are desirably provided in many different configurations to accommodate different specific uses. It is almost always desirable, however, to provide a reply envelope, and to have a preprinted return address associated with the reply envelope. This is often done by providing repositionable labels which are placed over the outgoing address on the outgoing envelope, or using inserts with the reply address for insertion into a window reply envelope. It is also desirable in mailers to provide the reply envelope with a relatively large size considering the outgoing size of the mailer.

According to the present invention, a mailer type business form, and an intermediate for construction thereof, are provided which allow a relatively large size of the reply envelope—if desired—since the reply envelope sealing flap is provided by an additional panel not taking up part of the panel surface of the outgoing envelope panels. Also, according to the invention, the reply address is associated with the reply envelope in such a way that a flap is provided connected to the reply envelope open end by a fold line, so that the flap may be folded into the reply envelope and be viewed through the cutout in a panel of the outgoing envelope (which also forms a panel of the reply envelope). The invention also relates to a unique reply envelope having a reply address flap connected by a fold line to the open end of the reply envelope, and foldable about the fold line to the interior of the envelope where the reply address is aligned with a cutout in the envelope.

According to one aspect of the present invention, an intermediate for a mailer type business form is provided having the following components: a sheet of paper having first and second faces, first and second parallel longitudinal edges, and first and second parallel side edges; at least first and second fold lines parallel to the longitudinal edges and defining the sheet into at least first, second and third panels, the second panel intermediate the first and third panels, the first panel adjoining the first fold line, and the third panel adjoining the second fold line; means defining a cutout in the second panel of a size sufficient for a complete postal address to be visible therethrough; first adhesive means provided on at least one of the first panel first face and the second panel first face for holding the first and second panels together to form a reply envelope; an outgoing address area formed on the first panel first face in alignment with the cutout when the first and second panels are folded about the first fold line with the first faces thereof in face-to-face engagement; first and second lines of weakness formed in the third panel extending parallel to the side edges to define with the second fold line a reply address flap; a reply address area on the reply address flap of the third panel, first face, in alignment with the cutout when the second and third panels are folded about the second fold line with the first faces thereof in face-to-face engagement; and second adhesive means formed along the edges of at least some of the panels for holding the panels together to form an outgoing mailer. An outgoing address is provided in the outgoing address area, and a reply address in the reply address area.

The invention also preferably comprises a third line of weakness formed in the third panel parallel to the second fold line and on the opposite side of the second fold line from the reply address area. It also preferably comprises a third fold line parallel to the first and second fold lines defining a fourth panel, the fourth panel having a dimension parallel to the sheet side edges much less than the dimensions of the first, second, and third panels parallel to the sheet side edges. The third fold line is between the first and fourth panels, and the fourth panel is defined by the third fold line and the first longitudinal edge; and the intermediate also further comprises an activatable adhesive pattern provided on the fourth panel first face, the fourth panel comprising a sealable flap for the reply envelope that can be formed from the first and second panels.

Further, the intermediate cutout is preferably formed approximately centrally in the second panel and has a width extending in a dimension parallel to the longitudinal edges, and wherein the first and second lines of weakness are spaced from each other in a direction parallel to the longitudinal edges a distance approximately equal to the width of the cutout. The activatable adhesive pattern may comprise a rewettable adhesive strip, and the first adhesive means may comprise heat seal adhesive disposed in a U-shaped pattern. There are also preferably fourth and fifth lines of weakness formed in the first and second panels adjacent the first fold line and parallel thereto the third, fourth and fifth fold lines being in alignment with each other when the sheet is folded about the first and second fold lines, and the first adhesive means being on the opposite side of one or both of the fourth and fifth lines of weakness from the first fold line.

The reply address flap may comprise a first reply address flap, and there also may be third and fourth lines of weakness parallel to the first and second lines of weakness and defining, with the first and second lines of weakness, the third panel into second and third reply address flaps, each including a reply address area on the second face of the third panel. A different reply address may be provided in each of the first through third reply address flaps.

According to another aspect of the present invention, an intermediate for a mailer type business form is provided comprising the following elements: a sheet of paper having first and second faces, first and second parallel longitudinal edges, and first and second parallel side edges; first, second and third fold lines parallel to the longitudinal edges and defining the sheet into first, second, third and fourth panels, the second panel intermediate the first and third panels, the first panel adjoining the first fold line, and the third panel adjoining the second fold line, and the first through third panels of approximately the same size and the fourth panel having a dimension parallel to the side edges that is much less than the comparable dimension of each of the first through third panels; first adhesive means provided on at least one of the first panel first face and the second panel first face for holding the first and second panels together to form a reply envelope; second adhesive means formed along the edges of at least some of the panels for holding the panels together to form an outgoing mailer; the third fold line disposed between the first and fourth panels, and the fourth panel being defined by the third fold line and the first longitudinal edge; and an activatable adhesive pattern provided on the fourth panel first face, the fourth panel comprising a sealable flap for the reply envelope that can be formed from the first and second panels.

According to another aspect of the invention, an envelope per se is provided. The envelope comprises the following components: a first panel having inner and outer faces, and a second panel with inner and outer faces, the inner faces of the panels connected together along three sides, and open on the fourth side; a cutout in the second panel large enough to contain a complete postal address; a flap connected by a first fold line to the first panel, at sid open, fourth, side and having an activatable adhesive pattern formed thereon to provide a sealing flap; a reply address flap connected to the second panel at the open, fourth, side by a second fold line, and a reply address on the reply address flap, and aligned with the cutout when the reply address flap is folded about the second fold line.

According to another aspect of the invention, a mailer type business form with a built-in reply envelope is provided. The mailer comprises: first through fourth plies, each having first and second side edges and first and second longitudinal edges; first ply being the top ply and having an outer face and an inner face, and a cutout therein; second ply having a top face and a bottom face, the top face having an outgoing address thereon in alignment with the cutout, the first and second plies having approximately the same dimensions; first adhesive means for holding the first and second plies together into a reply envelope having three closed sides and an open side, the open side at the first longitudinal edges of the first and second plies; the third ply having a width dimension much less than the width of the first and second plies, and connected to the second ply by a first fold line at the first longitudinal edges thereof, and having a top surface and a bottom surface, and an activatable adhesive pattern on the bottom surface; the fourth ply being the bottom ply and having approximately the same dimensions as the first and second plies, and having a top face and a bottom face; second adhesive means for holding the plies together adjacent at least the side edges thereof; and edge-adjacent lines of weakness just inside the second adhesive means for allowing ready opening of the mailer.

The mailer as described above also preferably further comprises first and second lines of weakness formed in the fourth ply parallel to the side edges to define a reply address flap between them, and a reply address disposed on the top face of the fourth ply. The fourth ply is typically connected to the first ply at the first longitudinal edges thereof by a second fold line. Also, the reply address being aligned with the cutout when the reply address flap is folded about the second fold line and inserted in the reply envelope.

According to yet another aspect of the invention, a mailer is provided comprising the following elements: at least first through third plies, each having first and second side edges and first and second longitudinal edges; first ply being the top ply and having an outer face and an inner face, and a cutout therein; second ply having a top face and a bottom face, the top face having an outgoing address thereon in alignment with the cutout, the first and second plies having approximately the same dimensions; first adhesive means for holding the first and second plies together into a reply envelope having three closed sides and an open side, the open side at the first longitudinal edges of the first and second plies; the third ply being the bottom ply and having approximately the same dimensions as the first and second plies, and having a top face and a bottom face; second adhesive means for holding the plies together adjacent at least the side edges thereof; edge-adjacent lines of weakness just inside the second adhesive means for allowing ready opening of the mailer; first and second lines of weakness formed in the third ply parallel to the side edges to define a reply address flap between them, and a reply address disposed on the top face of the fourth ply; the third ply being connected to the first ply at the first longitudinal edges thereof by a second fold line; and the reply address being aligned with the cutout when the reply address flap is folded about the second fold line and inserted in the reply envelope.

It is the primary object of the present invention to provide an advantageous mailer, and an intermediate for construction thereof and a reply envelope detachable therefrom, having a unique reply address flap, and a sealing flap which is foldable separate from the main mailer plies in the outgoing mailer.

DETAILED DESCRIPTION OF THE DRAWINGS

Figure 1:
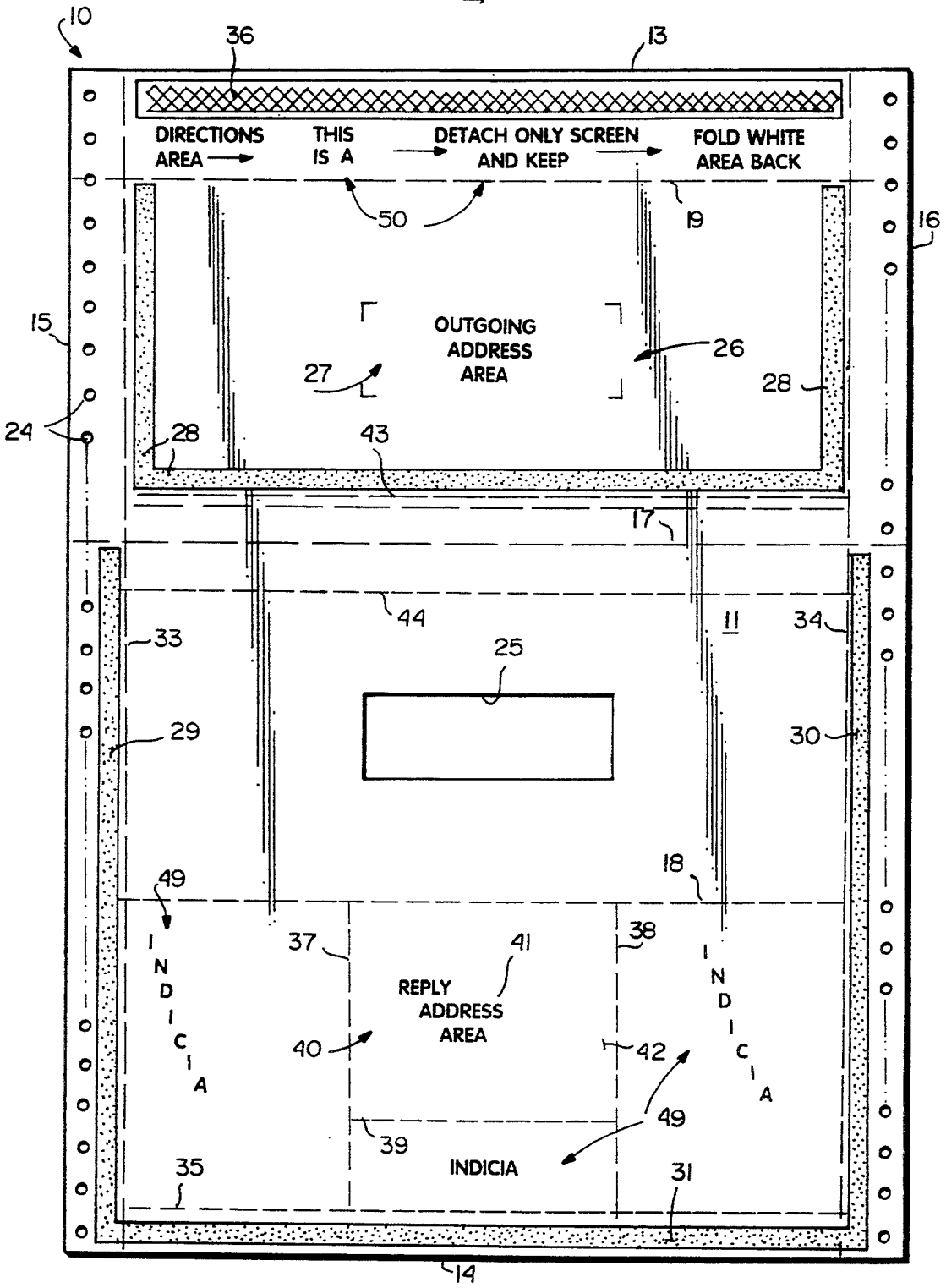
FIG. 1 is a top plan view of a first face of a first embodiment of an intermediate according to the present invention.
Figure 2:
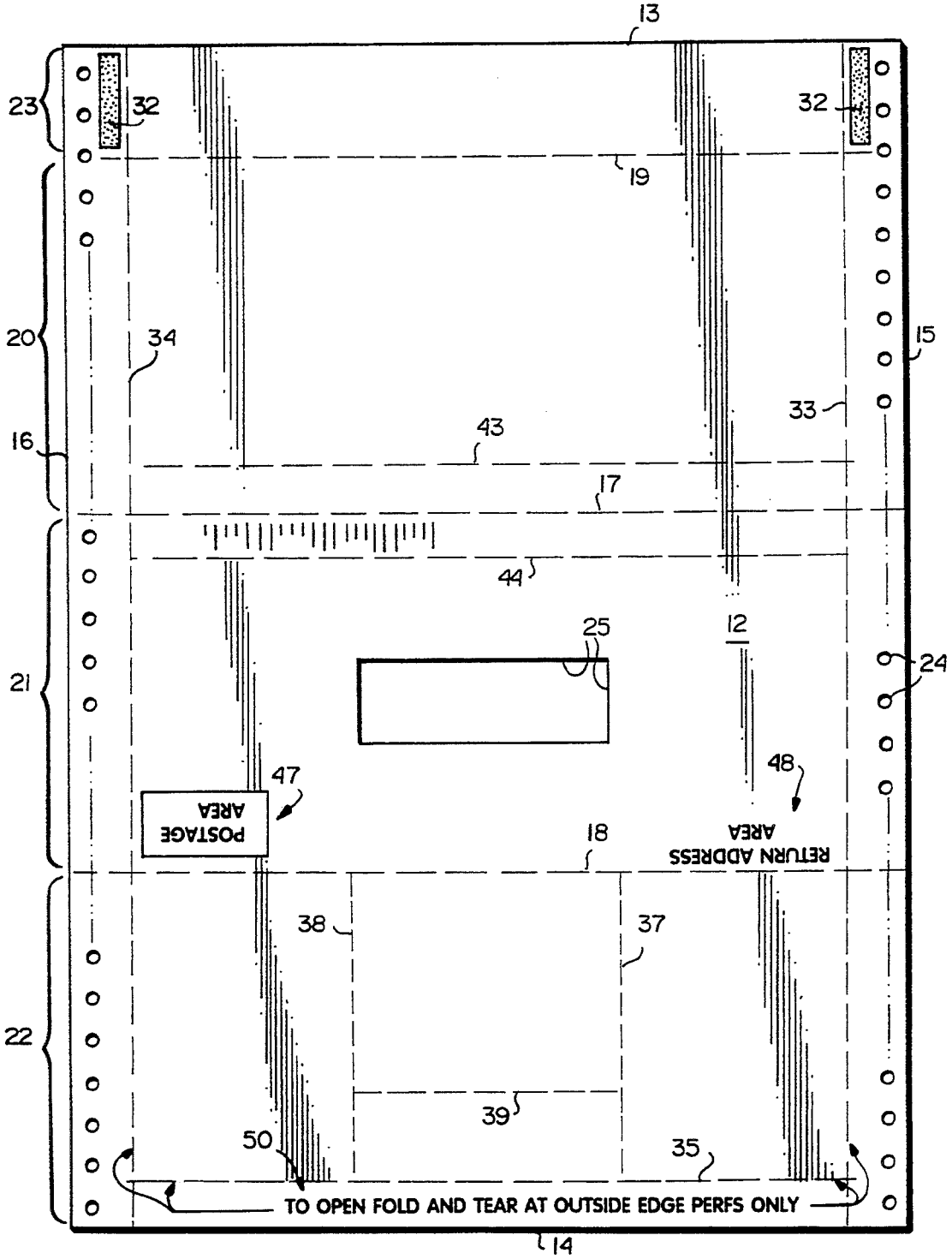
FIG. 2 is a top plan view of a second face of the intermediate of FIG. 1.
Figure 3:
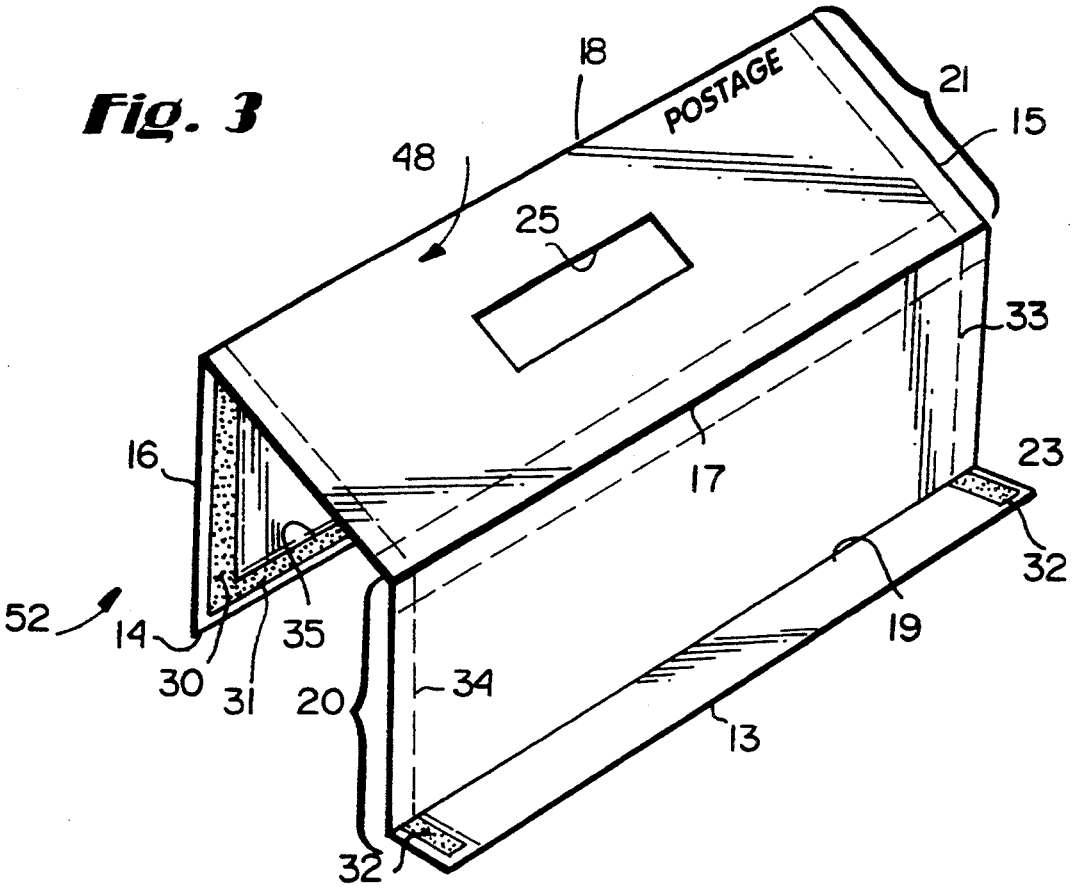
FIG. 3 is a top perspective view showing folding of he intermediate of FIGS. 1 and 2 about the fold lines thereof to form a mailer type business form.

An exemplary intermediate 10 according to the present invention is illustrated in FIGS. 1 and 2 and comprises a sheet of paper having first and second faces 11, 12 respectively (face 11 shown in FIG. 1 and face 12 in FIG. 2), first and second parallel longitudinal edges 13, 14, and first and second parallel side edges 15, 16 respectively. The intermediate 10 may be in continuous form, that is that the edges 13, 14 are perforations connected to like intermediates 10 during production, and for that purpose the side tractor drive holes 24 illustrated in FIGS. 1 and 2 are typically provided during manufacture (although they are desirably slit off, as is conventional, prior to production of the final mailer, as seen in FIG. 3).

The intermediate 10 also has first, second and third fold lines 17–19, respectively, which are parallel to the longitudinal edges 13, 14; the fold lines 17–19 may be lines of weakness, such as perforation lines, or merely score lines. The fold lines 17–19 define the sheet 10 into first through fourth panels 20–23, respectively (see FIG. 2). The panels 20–22 are of approximately the same size, while the fourth panel 23 has approximately the same width as the rest of the panels, but preferably a significantly smaller length (as is apparent in all of FIGS. 1–5).

According to the invention, preferably a cutout 25 is provided in the second panel 21, which in the embodiment illustrated in FIGS. 1 and 2 is substantially in the center of the panel 21. The cutout 25 may or may not be covered with a glassine sheet or patch, or the like. On the opposite side of the first fold line 17 from the cutout 25, in the first panel 20, there preferably is provided an outgoing address area 26, which at some point during construction of a mailer from the intermediate 10 will include a distinct outgoing postal address 27 (FIG. 1). The area 26 is aligned with the cutout 25 so that when intermediate 10 is folded about line 17 to move the faces 11 of the panels 20, 21 toward each other, the address indicia 27 will be visible through the cutout 25.

Figure 5:
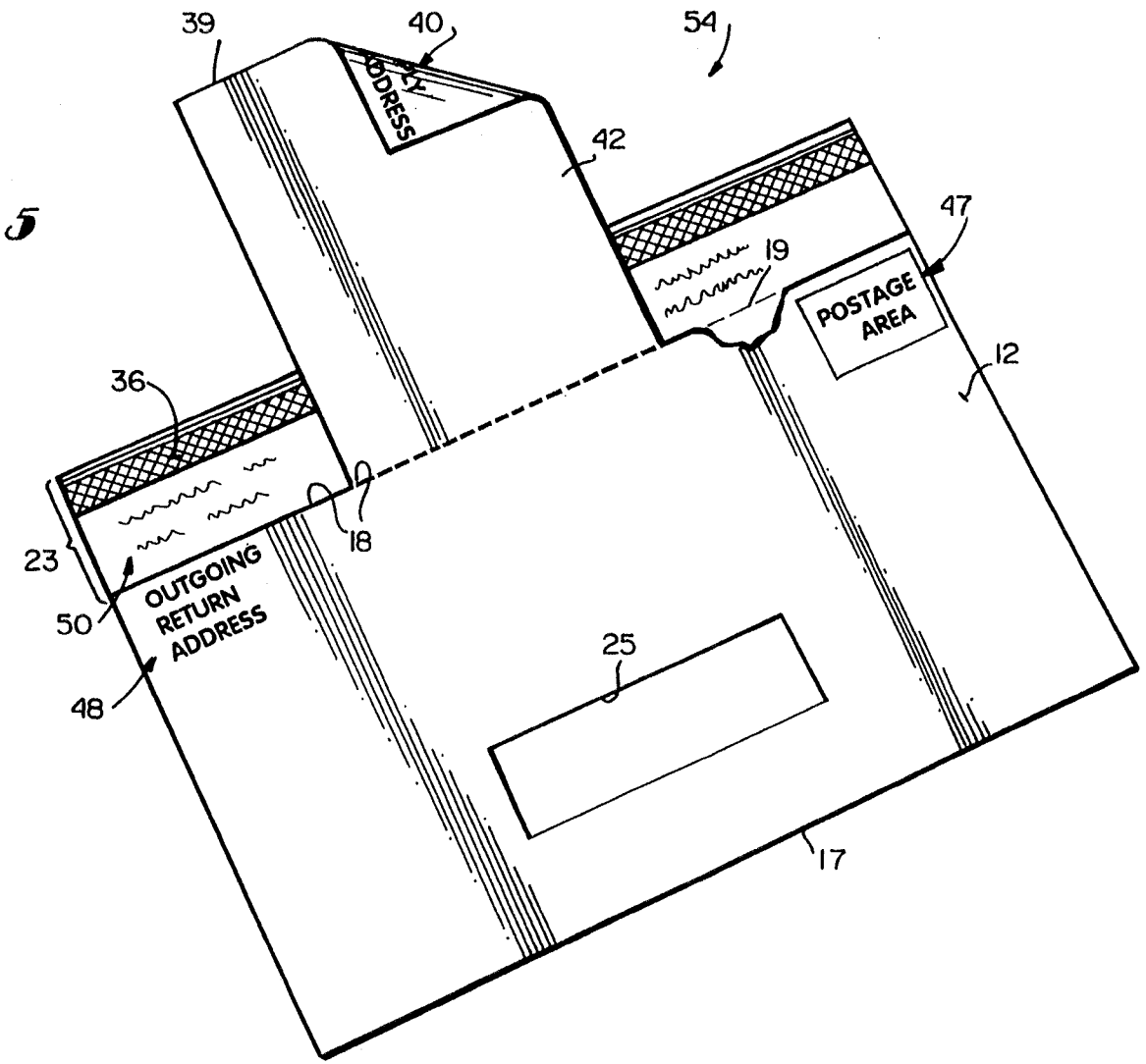
FIG. 5 is a top perspective view of a reply envelope separated from the mailer of FIGS. 3 and 4 after the mailer is opened up.

The intermediate 10 also comprises first adhering means 28 for holding the panels 20, 21 together (with their first faces 11 substantially in engagement with each other) when the sheet 10 is folded about line 17, the first adhering means 28 holding the panels 20, 21 together to form a reply envelope (see in FIG. 5, as will be hereafter explained). The adhering means 28 may comprise, as illustrated in FIG. 1, a U-shaped continuous strip of heat seal adhesive, although other types of adhesive may also be utilized, provided in different patterns. The adhesive 28 may be provided solely on the panel 20 first face 11, as seen in FIG. 1, or may be provided on the panel 21, or both panels 20, 21, depending upon many different variables or desires, such as the type of adhesive, equipment available, and details of the mailer to be constructed.

The intermediate 10 further comprises second adhering means for holding the panels 20–24 together when folded about the fold lines 17–19. The second adhering means may take the form of the continuous strips 29–31 of heat seal adhesive, or the like, disposed adjacent the edges 15, 16, and 14, respectively, as seen in FIG. 1, on the face 11 in the panels 21, 22, and the strips 32 on the second face of panel 23, adjacent the edges 15, 16 (see FIG. 2), also of heat seal adhesive or the like. Lines of weakness, in the form of perforations 33–35, for example, may be provided in all of the panels 20–23 to allow the mailer formed from the intermediate 10 to be readily opened, the perforation lines 33–35 being disposed on the opposite sides of the adhesive strips 29–32 from the edges 14–16 with which the strips 29–32 are associated.

The intermediate 10 also comprises a pattern of activatable adhesive, such as the continuous strip of rewettable adhesive 36 (FIG. 1), for sealing the reply envelope once the mailer made from the intermediate 10 is opened by the outgoing addressee, the strip 36 disposed on the first face 11 of panel 23 adjacent edge 13. Instead of rewettable adhesive, the pattern 36 may comprise pressure sensitive adhesive covered by a release liner, or other activatable adhesives known in the trade.

The intermediate 10 further comprises other lines of weakness formed in the third panel 22, such as the perforation lines 37–39, the lines 37 and 38 preferably (as illustrated in FIGS. 1 and 2) being spaced from each other a distance approximately equal to the width of the cutout 25 and address area 26, and the lines 37, 38 parallel to the edges 15, 16. The line 39, which is desirable merely to make the flap 42 a convenient size, is parallel to fold line 18. Located on the first face 11 of the flap 42 defined by the lines 18 and 37–39 is a reply address area 40, at some point during mailer manufacture having a complete postal reply address 41 imaged thereon. The reply address 41 is positioned with respect to the cutout 25 that if the flap 42 is folded about second fold line 18 with the faces 11 of the flap 42 and panel 21 brought toward each other, the reply address 41 is visible through the cutout 25.

The intermediate 10 also may include the lines of weakness (e.g. perforations) 43, 44 which are parallel to line 17 and straddle it, the adhesive 28 just on the opposite side of line 43 from the line 17. These lines 43, 44 also facilitate opening of the mailer formed from the intermediate 10, and access to the reply envelope constructed from panels 20, 21.

The second face 12 of the intermediate 10 preferably includes postage area indicia 47 and outgoing mailer return address indicia 48 (see FIG. 2) on the second panel 21 at appropriate positions, and with appropriate orientations, with respect to the cutout 25 and outgoing address 27. Indicia 49 is also preferably imaged on the portions of panel 22 outside the flap 42 on first face 11 (see FIG. 1), and instruction indicia 50 may be provided on both face 11 of the fourth panel 23, and face 12 of the third panel 22 as seen in FIGS. 1 and 2.

Figure 4:
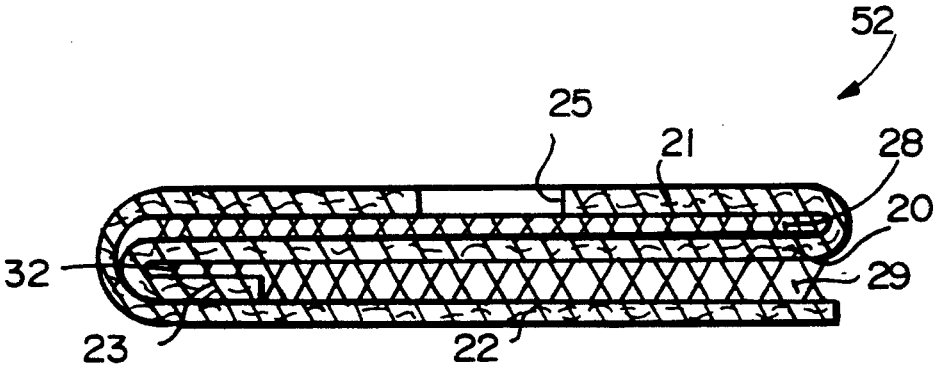
FIG. 4 is a cross-sectional view of the mailer of FIG. 3.

FIGS. 3 and 4 show an exemplary mailer 52 according to the present invention being constructed from the intermediate 10 after edge portions containing tractor drive holes 24 have been cut off. After folding of the panels 20–23 about the fold lines 17–19 as illustrated in FIGS. 3 and 4, the mailer 52 is passed through a conventional heat sealer, or other equipment for sealing the particular adhesive forming the patterns/strips 28–32, and the panels 20–23 are held together by the sealed adhesive, with the outgoing address 27 clearly visible through cutout 25. The various panels 20–23 thus form plies of the outgoing mailer 52, the top ply being the panel 21, the bottom ply the panel 22, and interior plies the panels 20, 23. If desired, an insert (not shown) may also be provided between the panels 20, 22 in the mailer 52.

The mailer 52 is opened by the outgoing addressee by tearing along the perforation lines 33–35, and 43, 44, exposing the interior indicia 49, and the reply envelope 54 (see FIG. 5). The panel 22 is also acted upon to tear along the perforation lines 37–39 so that the flap 42 remains attached (along fold line 18) to the reply envelope 54, but the indicia 49 containing portions are separated from the reply envelope 54. The reply address 41 is then provided for the reply envelope 54 by folding flap 42 about fold line 18, and tucking it inside the reply envelope 54, the reply address 41 then being clearly visible through and aligned with the cutout 25 (and covering the outgoing address 27). The fourth panel 23 then easily folds about fold line 19 so that it covers the indicia 47, 48 (see FIG. 5), and the rewettable adhesive strip 36 is wet just before fold-over of the panel 23 to seal panel 23 in place.

It will thus be seen that by providing the fourth panel 23, the intermediate and mailer according to the invention provide a compact outgoing mailer 52 configuration yet the reply envelope 54 may have a relatively large size since the panel 23 does not form part of the panels 20, 21 making up the reply envelope 54. Also, by providing the flap 42 with reply address area 40 thereon, a simple and effective means for reusing the outgoing mailer cutout 25 to also frame the reply address is provided.

Figure 6:
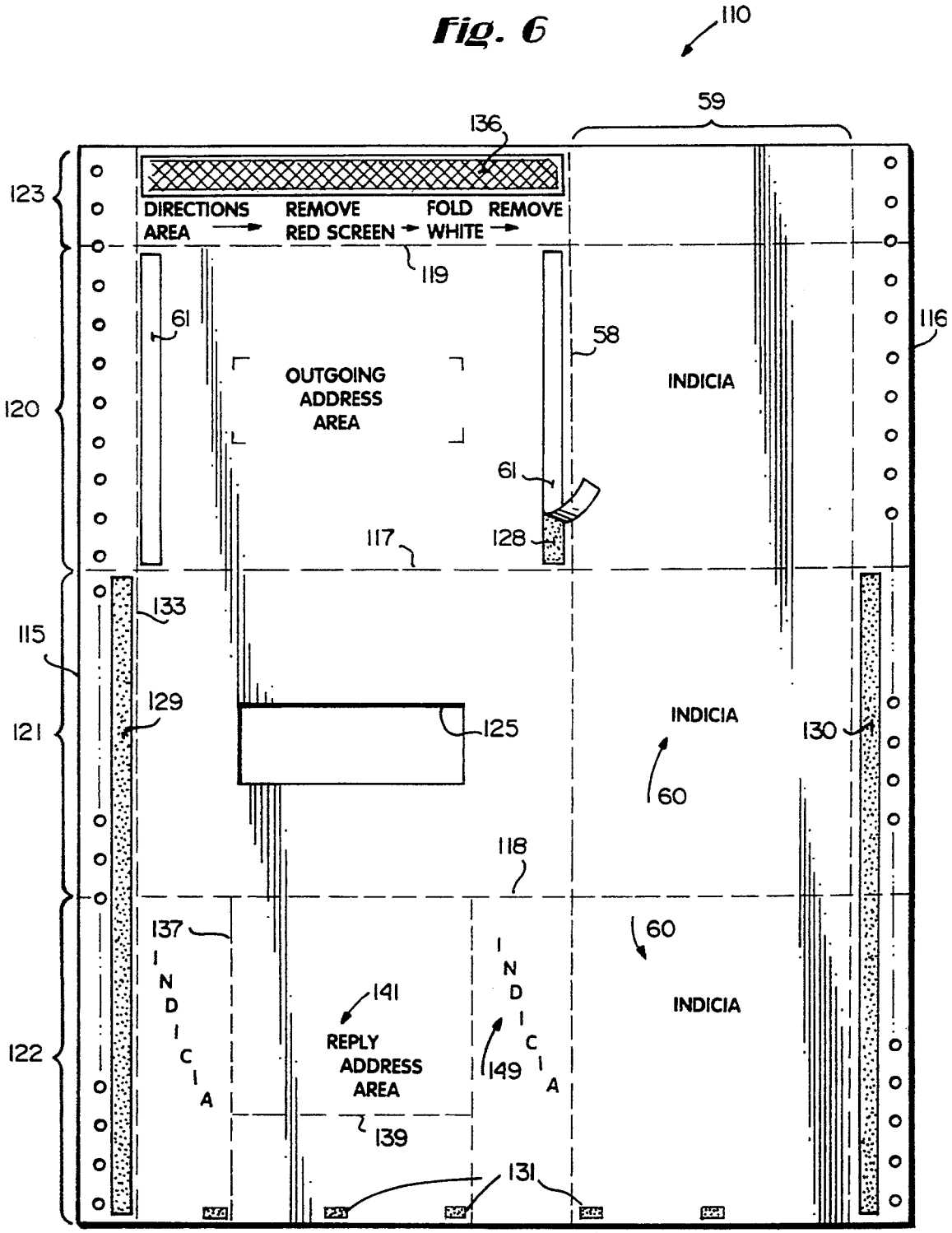
FIG. 6 is a view like that of FIG. 1 showing a second embodiment of intermediate according to the invention.

FIG. 6 illustrates an intermediate 110 that is a modification of the intermediate 10 of FIGS. 1 and 2, and thus makes a modified mailer/reply envelope. In the FIG. 6 embodiment elements comparable to those of the FIGS. 1 and 2 embodiment are shown by the same reference numeral only preceded by a "1", and attention is directed to the FIGS. 1 and 2 embodiment for a full description thereof. Only the significant distinctions between the FIGS. 1 and 6 embodiments will be described.

The FIG. 6 embodiment includes another line of weakness (e.g. perforation) 58 parallel to the edges 115, 116 and forming each panel 120–123 into subpanels. The rightmost side of FIG. 6 illustrates the subpanels collectively as 59, which are provided to allow additional indicia 60 to provide information to the mailer recipient, the reply envelope and like construction being provided on the left side of the line 58 as viewed in FIG. 6. Also in this embodiment, the adhering means 128 are provided a two continuous strips of pressure sensitive adhesive adjacent the perforation lines 133, 58 in panel 120 covered by release material strips 61, and no adhesive strip is provided adjacent the fold line 117 because the perforations 43, 44 are not provided in this embodiment. Further, the adhesive pattern 131 is provided in the form of a discontinuous strip (spaced blocks) rather than a continuous strip and no line of weakness comparable to the line 35 is necessary since the form 131 allows easier opening of the outgoing mailer.

Figure 7:
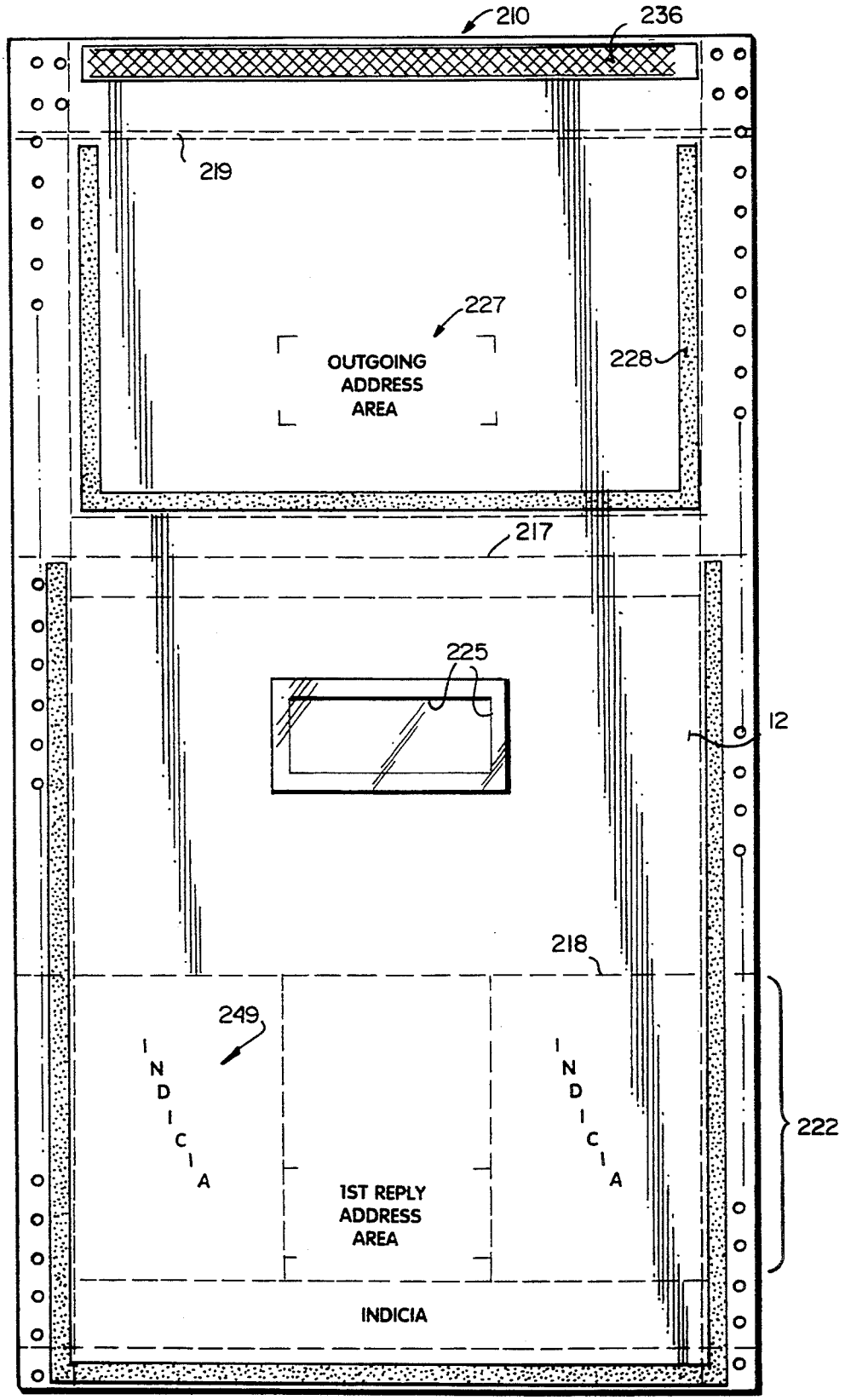
FIG. 7 is a view like that of FIGS. 1 and 6 showing a third embodiment of intermediate according to the invention.
Figure 8:
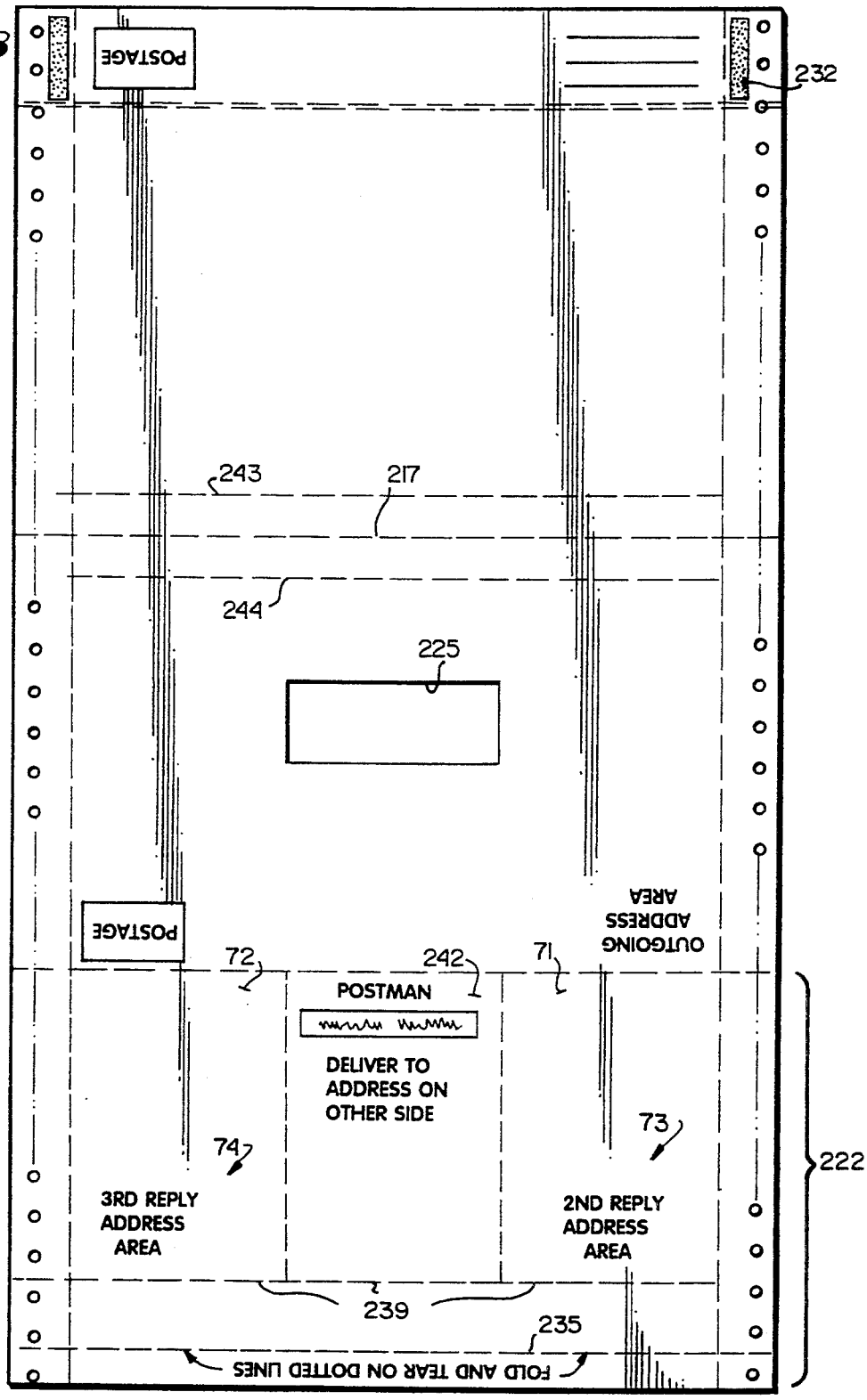
FIG. 8 is a view like that of FIG. 2 for the intermediate of FIG. 7.

FIGS. 7 and 8 illustrate yet another embodiment of an intermediate 210 according to the invention. In this embodiment, elements comparable to those in the FIGS. 1 and 2 embodiment are shown by the same reference numeral only preceded by a "2", and attention is directed to the verbal description of FIGS. 1 and 2 for a full description thereof.

The most significant difference between the embodiment of FIGS. 7 and 8 and that of FIGS. 1 and 2 is in the provision of the perforation line 239 across the width of the panel 222 so that in addition to the flap 242, there are also the flaps 71, 72, which—on the second face 112 thereof (see FIG. 8) have second and third reply addresses 73, 74, respectively, which are adapted to be aligned with the cutout 225 once the mailer is opened and the flaps 71, 72, 242 detached, so that the recipient has her/his choice of reply addresses depending upon what is included in the reply envelope, etc.

While the invention has been herein shown and described in what is presently considered to be the most practical and preferred embodiment thereof it is to be understood that many modifications may be made within the scope of the invention. For example, the cutout 25 may be off to one side of the panel 21, 221 rather than centrally located, and the reply address(es) 41, etc., correspondingly modified; the outgoing and reply envelopes may be made relatively larger; printing may be provided so that when the mailer is opened printing is part of the reply envelope (e.g. back of reply envelope), the intermediate and mailer could be made compatible with an 8121 folder/nestor, security printing could be provided where desired, etc. Thus the invention is to be accorded the broadest interpretation of the appended claims so as to encompass all equivalent structures and products.

What is claimed is:

1. An intermediate for a mailer type business form, comprising:

a sheet of paper having first and second faces, first and second parallel longitudinal edges, and first and second parallel side edges;

at least first and second fold lines parallel to said longitudinal edges and defining said sheet into at least first, second and third panels, said second panel intermediate said first and third panels, said first panel adjoining said first fold line, and said third panel adjoining said second fold line;

means defining a cutout in said second panel of a size sufficient for a complete postal address to be visible therethrough;

first adhesive provided on at least one of said first panel first face and said second panel first face for holding said first and second panels together to form a reply envelope;

an outgoing address area formed on said first panel first face in alignment with said cutout when said first and second panels are folded about said first fold line with said first faces thereof in face-to-face engagement;

first and second lines of weakness formed in said third panel extending parallel to said side edges to define with said second fold line a reply address flap;

a reply address area on said reply address flap of said third panel, first face, in alignment with said cutout when said second and third panels are folded about said second fold line with said first faces thereof in face-to-face engagement; and second adhesive formed along said edges of at least some of said panels for holding said panels together to form an outgoing mailer.

2. An intermediate as recited in claim 1 further comprising an outgoing address in said outgoing address area, and a reply address in said reply address area.

3. An intermediate as recited in claim 1 further comprising a third line of weakness formed in said third panel parallel to said second fold line and on the opposite side of said reply address area from said second fold line.

4. An intermediate as recited in claim 1 further comprising a third fold line parallel to said first and second fold lines defining a fourth panel, said fourth panel having a dimension parallel to said sheet side edges much less than the dimensions of said first, second, and third panels parallel to said sheet side edges.

5. An intermediate as recited in claim 4 wherein said third fold line is between said first and fourth panels, and said fourth panel is defined by said third fold line and said first longitudinal edge; and further comprising an activatable adhesive pattern provided on said fourth panel first face, said fourth panel comprising a sealable flap for the reply envelope that can be formed from said first and second panels.

6. An intermediate as recited in claim 5 further comprising exterior lines of weakness spaced on the opposite sides of said second adhesive from said side edges, and said second longitudinal edge.

7. An intermediate as recited in claim 1 wherein said cutout is formed approximately centrally in said second panel and has a width extending in a dimension parallel to said longitudinal edges, and wherein said first and second lines of weakness are spaced from each other in a direction parallel to said longitudinal edges a distance approximately equal to the width of said cutout.

8. An intermediate as recited in claim 6 wherein said activatable adhesive pattern comprises a rewettable adhesive strip, and wherein said first adhesive means comprises heat seal adhesive disposed in a U-shaped pattern.

9. An intermediate as recited in claim 7, further comprising third, fourth and fifth lines of weakness formed in said panels and parallel to said first fold line, said third, fourth and fifth lines of weakness being in alignment with each other when said sheet is folded about said first and second fold lines, and said first adhesive being on the opposite side of at least one of said fourth and fifth lines of weakness from said first fold line.

10. An intermediate as recited in claim 7; wherein said reply address flap comprises a first reply address flap; and further comprising third and fourth lines of weakness parallel to said first and second lines of weakness and defining, with said first and second lines of weakness, said third panel into second and third reply address flaps, each including a reply address area on said second face of said third panel.

11. An intermediate as recited in claim 10 further comprising an outgoing address in said outgoing address area, and a different reply address in each of said first through third reply address flaps.

12. An intermediate for a mailer type business form, comprising:

a sheet of paper having first and second faces, first and second parallel longitudinal edges, and first and second parallel side edges;

first, second and third fold lines parallel to said longitudinal edges and defining said sheet into first, second, third and fourth panels, said second panel intermediate said first and third panels, said first panel adjoining said first fold line, and said third panel adjoining said second fold line, and said first through third panels of approximately the same size and said fourth panel having a dimension parallel to said side edges that is much less than the comparable dimension of each of said first through third panels;

first adhesive provided on at least one of said first panel first face and said second panel first face for holding said first and second panels together to form a reply envelope;

second adhesive formed along the edges of at least some of said panels for holding said panels together to form an outgoing mailer;

said third fold line disposed between said first and fourth panels, and said fourth panel being defined by said third fold line and said first longitudinal edge; and an activatable adhesive pattern provided on said fourth panel first face, said fourth panel comprising a sealable flap for the reply envelope that can be formed from said first and second panels.

13. An intermediate as recited in claim 12 further comprising exterior lines of weakness spaced on the opposite sides of said second adhesive from said side edges, and said second longitudinal edge; and wherein said activatable adhesive pattern comprises a rewettable adhesive strip, and wherein said first adhesive comprises heat seal adhesive disposed in a U-shaped pattern.

14. An intermediate as recited in claim 13 further comprising third adhesive formed on said fourth panel second face adjacent said side edges of said sheet between said exterior lines of weakness and said side edges.

15. An intermediate as recited in 12 further comprising a line of weakness disposed parallel to said side edges adjacent a central part of said sheet, to define each of said panels into two portions, only the portions on one side of said line of weakness forming a reply envelope, while the portions on the other side of said line of weakness do not in any way define a reply envelope.

16. An envelope comprising: a first panel having inner and outer faces, and a second panel with inner and outer faces, said inner faces of said panels connected together along three sides, and open on the fourth side; a cutout in said second panel large enough to contain a complete postal address; a flap connected by a first fold line to said first panel at said open fourth side and having an activatable adhesive pattern formed thereon to provide a sealing flap; a reply address flap connected to said second panel at said open, fourth, side by a second fold line, and a reply address on said reply address flap, and aligned with said cutout when said reply address flap is folded about said second fold line.

17. A mailer type business form with a built-in reply envelope, comprising:

first through fourth plies, each having first and second side edges and first and second longitudinal edges;

first ply being the top ply and having an outer face and an inner face, and a cutout therein;

second ply having a top face and a bottom face, said top face having an outgoing address thereon in alignment with said cutout, said first and second plies having approximately the same dimensions;

first adhesive for holding said first and second plies together into a reply envelope having three closed sides and an open side, the open side at said first longitudinal edges of said first and second plies;

said third ply having a width dimension much less than the width of said first and second plies, and connected to said second ply by a first fold line at said first longitudinal edges thereof, and having a top surface and a bottom surface, and an activatable adhesive pattern on said bottom surface;

said fourth ply being the bottom ply and having approximately the same dimensions as said first and second plies, and having a top face and a bottom face;

second adhesive for holding said plies together adjacent at least the side edges thereof; and edge-adjacent lines of weakness just inside said second adhesive means for allowing ready opening of said mailer.

18. A mailer as recited in claim 17 further comprising first and second lines of weakness formed in said fourth ply parallel to said side edges to define a reply address flap between them, and a reply address disposed on said top face of said fourth ply; said fourth ply being connected to said first ply at said first longitudinal edges thereof by a second fold line; and said reply address being aligned with said cutout when said reply address flap is folded about said second fold line and inserted in said reply envelope.

19. A mailer as recited in claim 18 wherein said edge-adjacent lines of weakness are also provided just inside said second longitudinal edges of said first, second and fourth panels.

20. A mailer type business form with a built-in reply envelope, comprising:

at least first through third plies, each having first and second side edges and first and second longitudinal edges;

first ply being the top ply and having an outer face and an inner face, and a cutout therein;

second ply having a top face and a bottom face, said top face having an outgoing address thereon in alignment with said cutout, said first and second plies having approximately the same dimensions;

first adhesive for holding said first and second plies together into a reply envelope having three closed sides and an open side, the open side at said first longitudinal edges of said first and second plies;

said third ply being the bottom ply and having approximately the same dimensions as said first and second plies, and having a top face and a bottom face;

second adhesive for holding said plies together adjacent at least the side edges thereof;

edge-adjacent lines of weakness just inside said second adhesive for allowing ready opening of said mailer;

first and second lines of weakness formed in said third ply parallel to said side edges to define a reply address flap between them, and a reply address disposed on said top face of said fourth ply;

said third ply being connected to said first ply at said first longitudinal edges thereof by a second fold line; and said reply address being aligned with said cutout when said reply address flap is folded about said second fold line and inserted in said reply envelope.

* * * * *